US005312049A

United States Patent [19]

Bayler

[11] Patent Number: 5,312,049

[45] Date of Patent: May 17, 1994

[54] IMPROVED VALVE MECHANISM FOR A NOZZLE

[76] Inventor: Howard O. Bayler, 16041 Celtic St., Granada Hills, Calif. 91344

[21] Appl. No.: 914,552

[22] Filed: Jul. 16, 1992

[51] Int. Cl.[5] ..... B05B 1/30

[52] U.S. Cl. ..... 239/578; 239/583; 239/602; 251/340

[58] Field of Search ..... 239/578, 602, 583, 586, 239/530; 251/340, 155

[56] References Cited

U.S. PATENT DOCUMENTS

| | | | |
|---|---|---|---|
| 669,845 | 3/1901 | Melavin | 239/602 |
| 1,745,323 | 1/1930 | Coe et al. | 239/530 |
| 2,695,069 | 11/1954 | Boerner | 239/578 |
| 2,955,798 | 10/1960 | Sights | 251/340 |
| 3,273,804 | 9/1966 | Wilson | 239/602 |
| 4,495,965 | 1/1985 | Ise | 251/340 |
| 4,522,592 | 6/1985 | Johnson | 251/340 |
| 4,848,403 | 7/1989 | Pilolla et al. | 251/340 |
| 4,872,643 | 10/1989 | Lo | 251/340 |

*Primary Examiner*—Andres Kashnikow
*Assistant Examiner*—Lesley D. Morris
*Attorney, Agent, or Firm*—Frank L. Zugelter

[57] ABSTRACT

A nozzle mechanism (10) comprising a flexible barrel (13) annularly spaced about a fluid jetting tube (12) apertured as at (16) to a rear tubular portion (15), a manipulative sleeve (33) on the barrel (13), and a valve control member (24) to open and close its valve (28) aligned with aperture (16). Valve control member (24) includes a pin 29 operatively connected to the sleeve (33) via a slot (30) in barrel (13), so that manipulative motion of sleeve (33) opens and closes valve (28), as well as locking open valve (28) by reason of pin (29) being retained in a catch (31) on slot (30) in flexible barrel (13).

20 Claims, 4 Drawing Sheets

IMPROVED VALVE MECHANISM FOR A NOZZLE

TECHNICAL FIELD

This invention relates to nozzles for use on fluid hoses, and in particular is directed to an improved nozzle mechanism having a valve and which is flexible in character to generate degrees of spray of and to direct fluid (egs., water/air) flow in a desired direction when its valve is open.

BACKGROUND ART

Disclosures of prior art nozzles are found in the following U.S. Pat. Nos.: 633,069; 841,322; 988,943; 1,398,133; 2,955,798; and 3,072,345

DISCLOSURE OF INVENTION

This invention is directed to a nozzle mechanism by which the force of flow of water or air maintains the nozzle's valve in closed position or mode, yet keeps the valve open when desired. By manipulating a sleeve rearwardly of an outer nozzle barrel, first by reciprocation, and then if desired by rotating it about the barrel, the valve is locked in an open mode for flow of water or air through an inner jet tube. A control member for the valve, located between jet tube and barrel, at its distal end includes a pin that projects through a bayonet slot in the barrel and into a hole in the sleeve. The valve itself is disposed in a rear tubular portion of the nozzle mechanism and at the other end of the member which extends through the bottom of such rear tubular portion. A channel is provided on the jet tube to retain control of a positioning for the valve's control member in its reciprocating motion. The outer barrel is flexible and is longer than the jet tube to provide for a dispensing chamber, and in its flexible condition a thumb may bend its dispensing end to deflect the jetted water into any direction, into kinds of spray, and to any degree of spray.

An object of this invention is to provide an improved mechanism for a nozzle.

Another object of this invention is to provide an e device.

A further object of the invention is to provide a readily operable valve mechanism for an ordinary nozzle.

A still further object of the invention is to provide various kinds and degrees of water spray in any desired direction from the nozzle without finger burn.

These and other objects and advantages will become more apparent from a complete and full reading from the following description, the amended claims thereto, and the drawing comprising seven (7) FIGURES (5 sheets).

BEST MODE (S) FOR CARRYING OUT THE INVENTION

Figure 1:
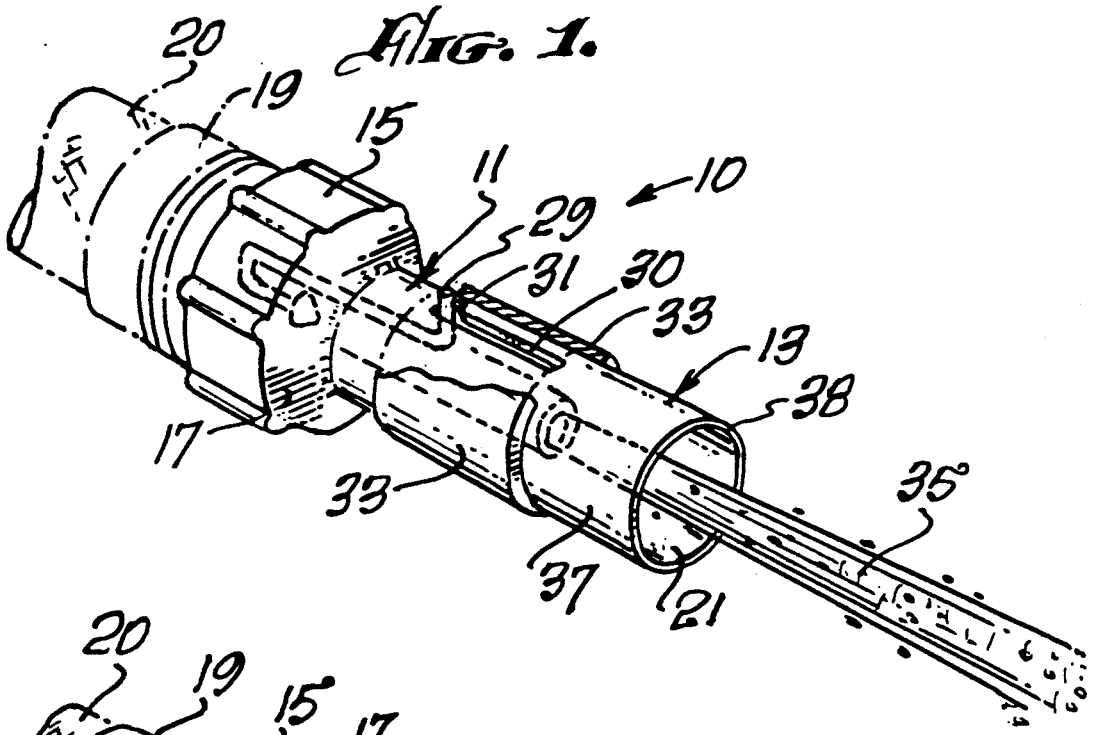
FIG. 1 is a perspective view of the improved nozzle attached to a hose, and in an operational mode.

Referring now to the drawing wherein reference characters correspond to like numerals hereinafter, FIGS. 1-7 illustrate the preferred embodiment of the invention. The improved nozzle mechanism 10 comprises a housing 11 having integrally formed therein an inner tubular member 12 providing for jetting of water and an outer barrel 13 annularly spaced as at 14 therefrom, both extending in the same direction from a rear tubular portion 15. An aperture 16 in a bottom 17 of the rear tubular portion 15 provides for ingress of fluid, such as water or air, into tube 12 upon attachment by its internal threads 18 to a threaded nipple 19 suitably secured on the end of a hose 20, in a usual manner of attachment. The barrel 13 includes a length longer than that of nozzle tube 12, the annular space 14 thereby expanding into a dispensing chamber 21 in front of nozzle tube 12. Barrel 13 is flexible in nature, for directing the dispensed fluid, and for generating various kinds and degrees of spray, one's thumb flexes barrel 13 in operation rather than being burned by water force at the end of member 12. A channel 22 is formed upon nozzle tube 12 by means of a pair of integrally formed spaced rails 23 extending radially into annular space 14 and generally longitudinally along tube 12 for a sufficient length therealong to retain control of a positioning of a valve control member rod 24 that reciprocates as well as being capable of to-and-fro motion therein and therealong.

Figure 5:
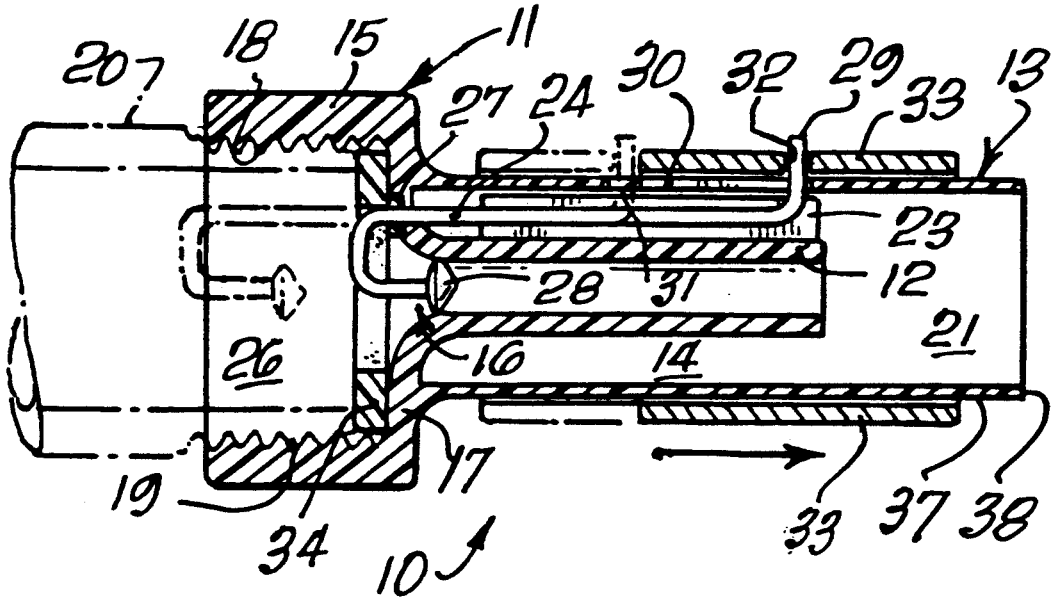
FIG. 5 is a sectional view of such nozzle in its closed mode.
Figure 7:
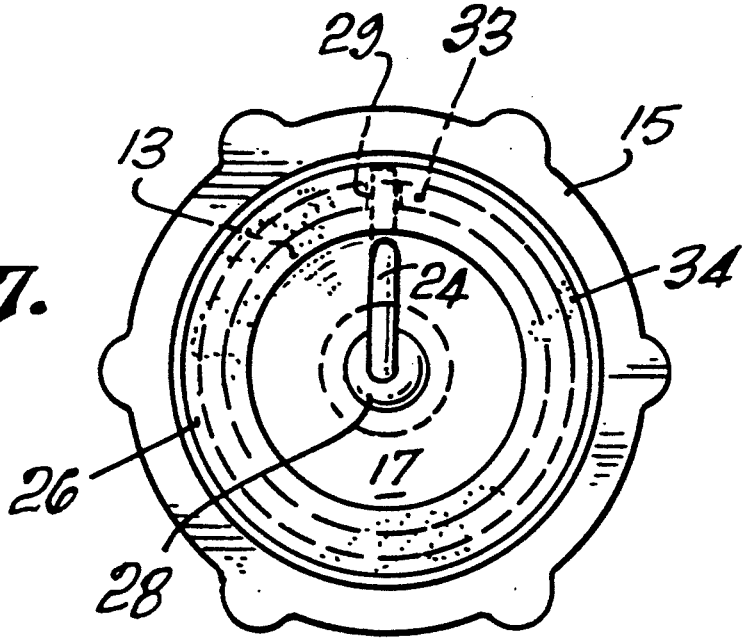
FIG. 7 is a rear end view of the improved nozzle.

Control rod 24 extends in general parallel fashion to and rearwardly from over barrel 13 to project through aperture 16 in the bottom 17 of and into the interior 26 FIGS. 5, 7, of rear tubular portion 15. An O-ring 27 slip fits about rod 24, seating in a circular recess about hole 25 in the bottom 17 of tubular portion 15 to prevent water leakage into the annular space 14 between barrel 13 and tube 12. Control rod 24 is turned, bent or U-shaped in its part disposed within the interior 26 so that a valve 28 mounted at its end aligns with the aperture 16. At the other or distal end of rod 24, a pin 29 is fashioned by bending the rod 24 in a radial direction to project through a bayonet slot 30 having a catch 31 formed in barrel 13. Pin 29 extends into and through a hole 32 formed in a reciprocable and rotatable sleeve 33 mounted on barrel 13. A washer 34 is applied to the bottom 17 of tubular portion 15 in the usual manner for sealing the mechanism 10 to nipple 19 when it is threaded thereto, thereby providing a non-leak fit in the threaded union.

Figure 4:
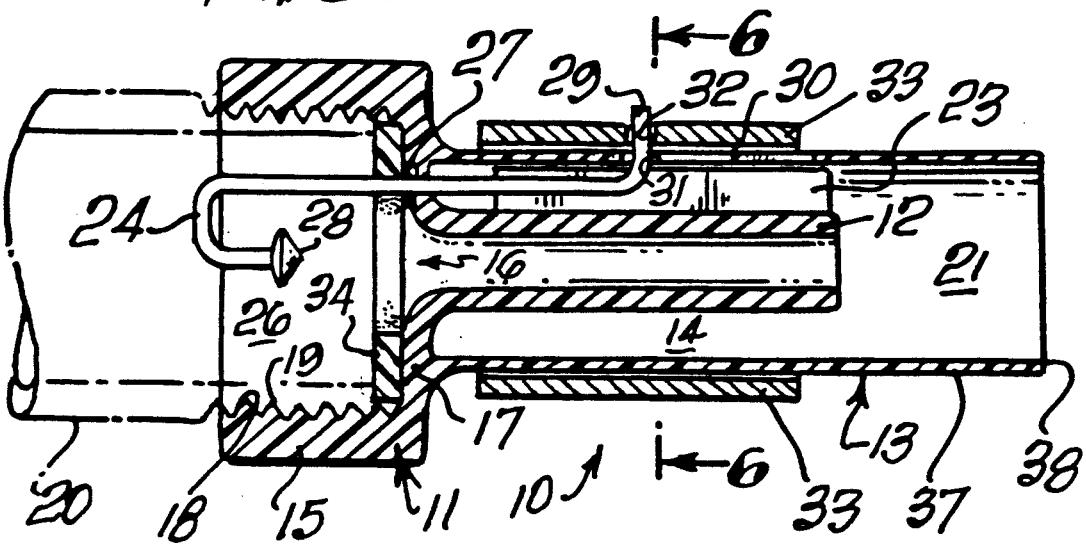
FIG. 4 is a sectional view of the nozzle, with the nozzle in an open mode for operation.
Figure 6:
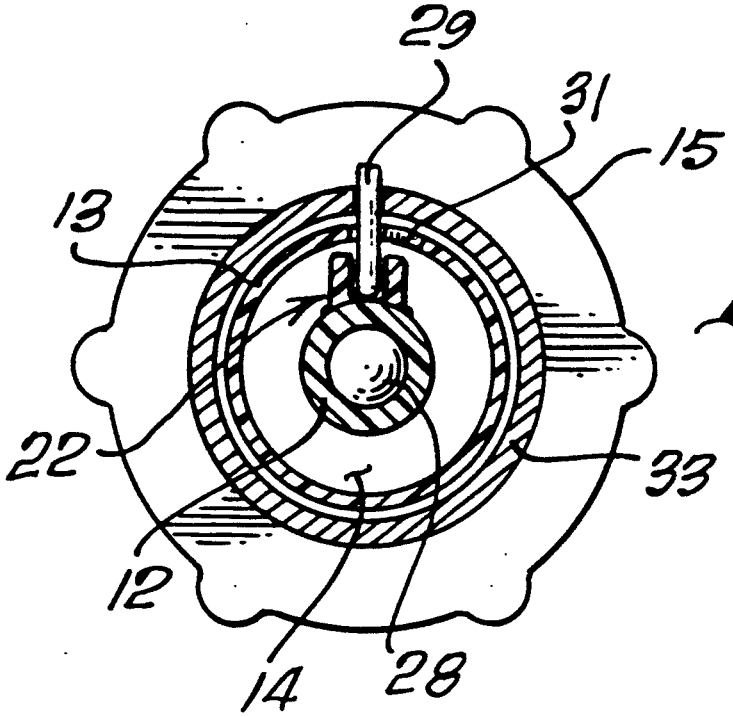
FIG. 6 is a view taken on line 6—6 of FIG. 4.

In operation, nozzle mechanism 10 is threaded to the hose's nipple 19, washer 34 providing the non-leak fit between the hose and nozzle. The valve 28 is in closed mode, i.e., seated upon aperture 16 by reason of sleeve 33 being forward on barrel 13, FIG. 5, pin 29 not being in the catch 31 of bayonet slot 30. Water 35 is caused to flow in the hose 20, into rear tubular portion 15, and thus against valve 28. Water 35 does not flow through nozzle tube 12 or the nozzle itself. Sleeve 33 is reciprocated rearwardly, carrying pin 29, and thus control member 24 rearwardly, opening valve 28 at aperture 16. Water 35 flows into and through tube 12 and into dispensing chamber 21 and thence outwardly thereof into the atmosphere. By turning or rotating sleeve 33, thereby directing pin 29 into the catch 31 of the bayonet slot 30, valve 28 is revolved out of alignment with aperture 16 and locked in open mode by the pin 29 in catch 31 against the force of flowing water 35. It should be noted here that FIG. 6 illustrates the open mode immediately prior to turning or rotating sleeve 33, and it should be understood that when such turning or rotating is accomplished, valve 28, FIG. 6, has become unseated from aperture 16. FIG. 4 may also be seen in this light although FIG. 4 appears to show that valve 28 is in alignment with aperture 16.

Figure 2:
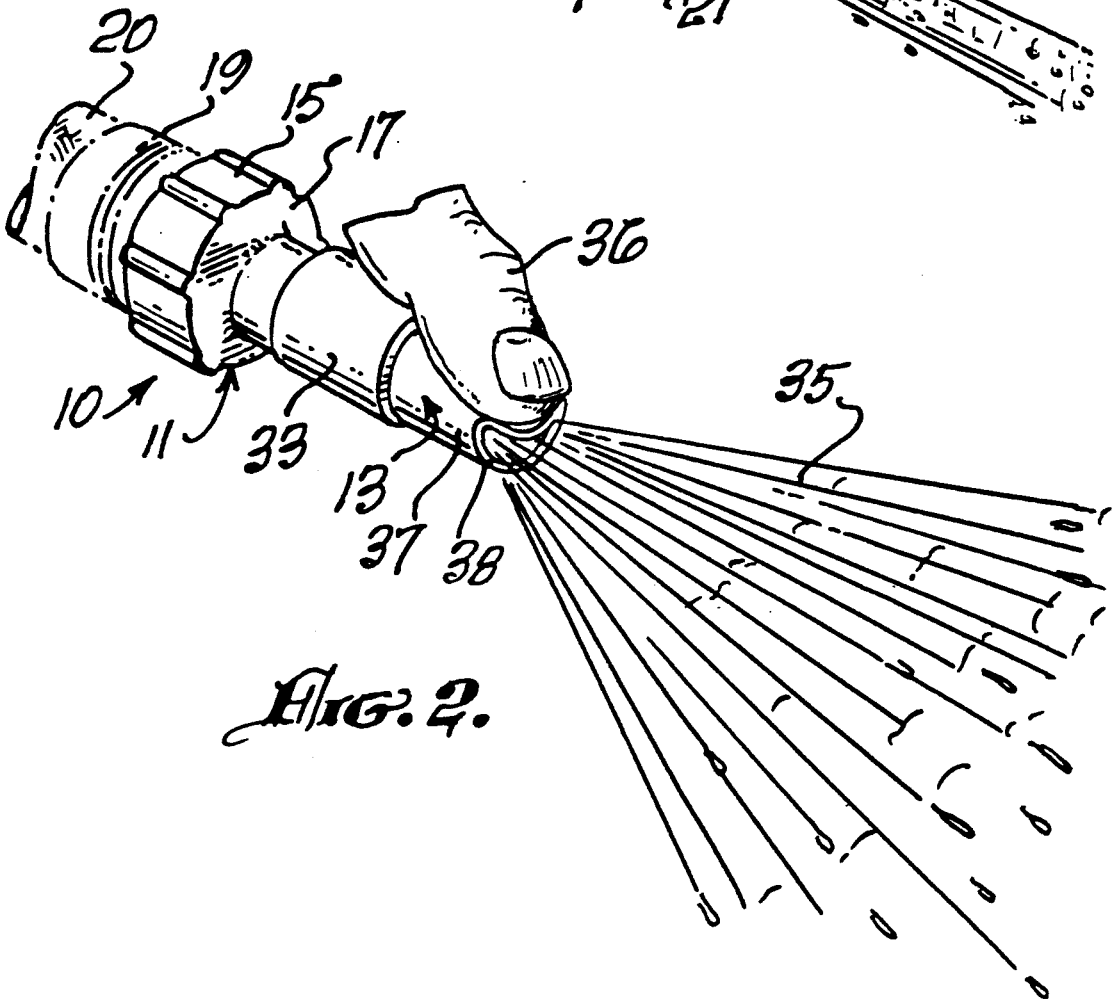
FIG. 2 is a perspective view of the nozzle in FIG. 1 in a different operating mode of use.
Figure 3:
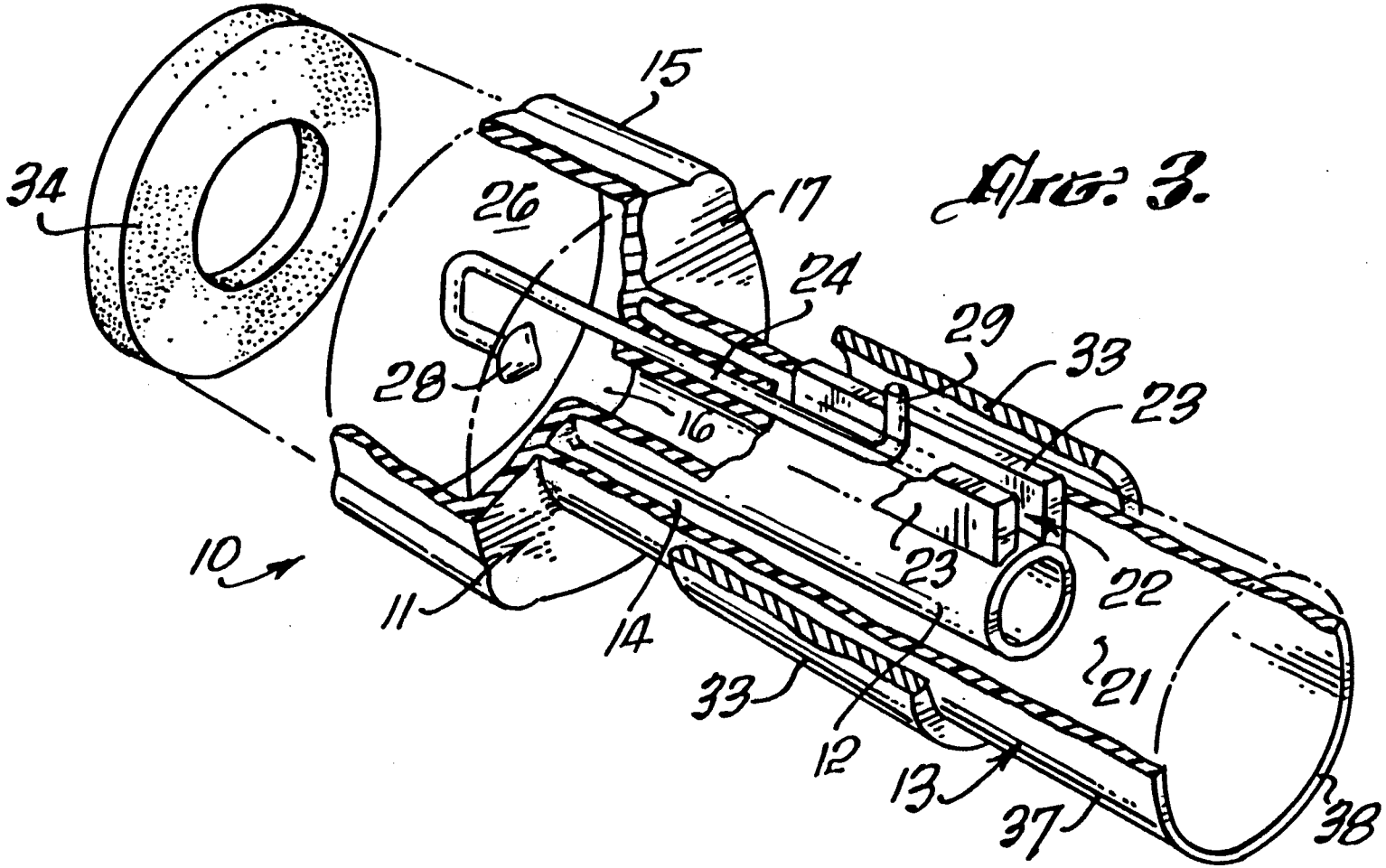
FIG. 3 is a perspective view, broken away, and partly in section, of the improved nozzle.

The application of a thumb 36, FIG. 2, to a flexible portion 37 and/or rim 38 of barrel 13 provides for various kinds of sprays of water/air from the nozzle as well as directing them. Application without thumb 36 changing the circumferentiality of portion 37 or rim 38 provides for a coarse water spray. Application in varying degrees of the thumb 36 to close off dispensing chamber 21 provides for varying degrees of spray of water from the nozzle, with a fine spray being achieved by a heaviest of thumb application. The location of thumb 36 at a particular point on portion 37 or rim 38 determines generally the direction of any spray thereby.

To shut off the flow of water 35 through nozzle 10, sleeve 33 is rotated in a reverse manner to remove pin 29 from catch 31 of bayonet slot 30. Valve 28 aligns with aperture 16. Manually reciprocating sleeve 33 forwardly moves pin 29 forwardly in slot 30, seating valve 28 on aperture 16, although this may be accomplished by the force of the flowing fluid or water itself pushing forward valve 28. Control rod 24 of course moves forwardly, as does sleeve 33 and pin 29. The force of the water itself maintains closure of valve 28 about aperture 16.

In assembly, the valve control member 24, and valve 28 and O-ring 27 thereon, having been fashioned into its illustrated configuration but prior to fashioning pin 29 by bending it, is inserted through hole 25. O-ring 27 is seated into its recess about aperture 16.

Upstanding pin 29 is fashioned. Rod 24 is caused to be disposed between, and thereby its to-and-fro motion and positioning maintained by, rails 23. Sleeve 33 with its hole 32 is slipped onto flexible portion 37 of barrel 13. The bending or flexing ability of rod 24 provides for depression of pin 29 so that sleeve 33 slides over it until the pin finds the sleeve's hole 32 and pops into it.

The above described elements are made from known and suitable materials. Housing 11 is formed from plastic via known molding processes and may or may not include channel 22. Rod 24 is formed from a thin but rigid brass member while valve 28, of brass, is suitably secured such as by welding to a straight brass member prior to configuring it into control rod 24. Valve 28 is preferably fashioned with its head in a conical shape so that it readily meets the body formation of aperture 16 to seal off inner tube 12. Sleeve 33 is made from suitable fabric, metal or plastic materials. Washer 34 is of garden hose variety.

Various changes and modifications may be made without departing from the spirit or scope of the invention. A metal or brass insert into interior 26, with threads on it complementing threads on the end of a hose, may connect the device to the hose. Were the device made of rubber, O-ring 27 may not be needed. The thickness of barrel 13 should include flexibility for ease of application of thumb 36, yet be sufficiently thick to prevent longitudinal cracking of the material along portion 37 or at rim 38 when a thumb 36 is applied. Neopreme rubber appears to be suitable material.

I claim:

1. A nozzle comprising a rear portion, an interior in the rear portion, and a tube having an aperture communicating with such interior, a flexible barrel spacedly mounted about and longer than said tube so as to provide an annular space about the tube and forming a dispensing chamber in front of said tube, slot means formed in said barrel, valve means disposed in said rear portion, a control member for said valve means being disposed in said rear portion and extending into the annular space about said tube, means mounted on said control member projecting through said slot means, and a sleeve manipulatively mounted on said barrel, said projecting means operatively connected to said sleeve, whereby manipulative motion of said sleeve with respect to said barrel unseats and seats said valve means with respect to said aperture.

2. The nozzle of claim 1 wherein said slot means includes a catch, said projecting means being received in said catch in further manipulation of said sleeve with respect to said barrel to thereby lock said valve means in an open mode.

3. The nozzle of claim 2 wherein said projecting means comprises a pin formed on said control member.

4. The nozzle of claim 3 including means for maintaining a positioning of said control member along the annular space mounted on said tube.

5. The nozzle of claim 4 wherein said maintaining means comprises a channel.

6. The nozzle of claim 5 wherein said channel is formed by a pair of spaced rails.

7. The nozzle of claim 2 including means for maintaining a positioning of said control member along the annular space mounted on said tube.

8. The nozzle of claim 7 wherein said maintaining means comprises a channel.

9. The nozzle of claim 8 wherein said channel is formed by a pair of spaced rails.

10. The nozzle of claim 1 including means for maintaining a positioning of said control member along the annular space mounted on said tube.

11. The nozzle of claim 10 wherein said maintaining means comprises a channel.

12. The nozzle of claim 11 wherein said channel is formed by a pair of spaced rails.

13. A mechanism, adapted for a fluid jetting tube mounted on a rear interior portion adapted to connect to a fluid source, with an aperture communicating said fluid jetting tube with said rear interior portion, said mechanism comprising a flexible barrel disposed about said fluid jetting tube thereby forming an annular space and extending from said rear interior portion to beyond said fluid jetting tube, a valve disposed within said rear interior portion for seating and unseating on the aperture, and control means for seating and unseating said valve and disposed in said rear interior portion and extending from said rear interior portion into the formed annular space and further about said flexible barrel.

14. The mechanism of claim 13 wherein said control means comprises a member disposed in the formed annular space and having ends, its one end extending into said rear interior portion and being operatively connected to said valve, slot means formed in said barrel, a pin radially mounted at the other of said ends of said member projecting through said slot means, and a manipulative sleeve mounted on said flexible barrel operatively connected to said pin.

15. The nozzle mechanism of claim 14 including means for maintaining a positioning of said member along the annular space mounted on said tube.

16. The nozzle mechanism of claim 15 wherein said maintaining means comprises a channel.

17. The nozzle mechanism of claim 16 wherein the channel is formed by a pair of spaced rails.

18. The nozzle mechanism of claim 13 including means for maintaining a positioning of said member along the annular space mounted on said tube.

19. The nozzle mechanism of claim 18 wherein said maintaining means comprises a channel.

20. The nozzle mechanism of claim 19 wherein the channel is formed by a pair of spaced rails.

* * * * *